US006624807B2

(12) United States Patent
Bredow et al.

(10) Patent No.: US 6,624,807 B2
(45) Date of Patent: Sep. 23, 2003

(54) MANUAL CONTROL DEVICE WITH A JOYSTICK

(75) Inventors: Wolfgang Bredow, Niefern-Öschelbronn (DE); Thomas Haug, Ölbronn (DE); Thomas Burchard, Pforzheim (DE)

(73) Assignee: Integrated Electronic Systems ISYS Consulting GmbH, Ölbronn-Dürm (DE)

( * ) Notice: Subject to any disclaimer, the term of this patent is extended or adjusted under 35 U.S.C. 154(b) by 0 days.

(21) Appl. No.: 10/166,729

(22) Filed: Jun. 12, 2002

(65) Prior Publication Data

US 2003/0006963 A1 Jan. 9, 2003

(30) Foreign Application Priority Data

Jun. 12, 2001 (DE) ..... 101 28 436

(51) Int. Cl.[7] ..... G09G 5/08
(52) U.S. Cl. ..... 345/161; 74/471 R; 200/5 R
(58) Field of Search ..... 345/156–184; 74/471 R–471 XY; 200/5 R

(56) References Cited

U.S. PATENT DOCUMENTS 1,824,090 A 9/1931 Lord
4,658,666 A 4/1987 Liu
5,680,796 A * 10/1997 Wustenberg et al. ... 74/471 XY
6,082,216 A * 7/2000 Watanabe et al. ..... 74/473.3
6,109,130 A * 8/2000 Will ..... 74/470
6,433,066 B2 * 8/2002 Kirino et al. ..... 524/492

* cited by examiner

*Primary Examiner*—Richard Hjerpe
*Assistant Examiner*—Mike Fatahiyar
(74) *Attorney, Agent, or Firm*—Browdy and Neimark, P.L.L.C.

(57) ABSTRACT

A manual control device composed of: a housing; a joystick; and a joint supporting the joystick in the housing to enable the joystick to pivot about two mutually orthogonal axes relative to the housing. The joint is an elastic molded plastic part composed of an interior portion secured to the joystick, a peripheral portion secured to the housing and a connecting portion extending between, and connecting, the interior portion and the peripheral portion. The interior portion has the form of a first cylinder and the peripheral portion has the form of a second cylinder, the first and second cylinders being concentric with one another when the joystick is in a neutral position. The connecting portion has a frustoconical shape when the joystick is in the neutral position and is stressed when the joystick is pivoted away from the neutral position.

9 Claims, 1 Drawing Sheet

MANUAL CONTROL DEVICE WITH A JOYSTICK

BACKGROUND OF THE INVENTION

The present invention relates to manual control devices having a joystick. Such devices are used in the field of industrial control technology to control construction machines or industrial robots. The two-dimensional motions of the control stick (joystick) are is, converted here, via contacts or relays, into electrical signals, which are transmitted especially in wireless fashion by means of a remote-control transmitter to a receiver in or on the industrial equipment to be controlled, where they bring about a corresponding motion, such as deflection of a robot arm.

For the pivoting motion, the joystick must be retained in a joint that is sturdy, invulnerable to dirt, and sealed against splashing water and that has great stability under load, so that it can function reliably under the often rough conditions of use in the industrial control field.

A known manual control device is disclosed in EP 0 683 906 B1. The joint of this device is an elastomer joint, whose cross-sectional design is such that upon maximal deflection of the joystick, an essentially rectilinear surface line of intersection is created in the region of greatest expansion, while the opposed region, stressed for compression, becomes increasingly deeper. This arrangement makes good retention of a fixed articulation point possible even in the pivoted position of the joystick, but the relatively voluminous design of the elastomer joint leads to large-volume compression or stretching of the various regions when they are stressed during pivoting, which with frequent stress causes fatigue of the elastomer joint.

BRIEF SUMMARY OF THE INVENTION

The present invention provides a refinement of the previously known elastomer joint such that greater reliability and a greater stability under load are achieved.

The invention provides a manual control device composed of: a housing; a joystick; and a joint supporting the joystick in the housing to enable the joystick to pivot about two mutually orthogonal axes relative to the housing. The joint is an elastic molded plastic part composed of an interior portion secured to the joystick, a peripheral portion secured to the housing and a connecting portion extending between, and connecting, the interior portion and the peripheral portion. The interior portion has the form of a first cylinder and the peripheral portion has the form of a second cylinder, the first and second cylinders being concentric with one another when the joystick is in a neutral position. The connecting portion has a frustoconical shape when the joystick is in the neutral position and is stressed when the joystick is pivoted away from the neutral position.

The fundamental concept of the invention is that because the connecting region that is stressed upon pivoting is designed with relatively narrow walls in the form of a frustoconical jacket, more-precisely defined stress regions are created. These regions are defined predominantly as walls stressed for expansion on the one hand and as jointlike, relatively small-volume compression regions on the other hand.

The demands made can be met in conjunction with a suitable choice of the opening angle of the frustoconical connecting region, of the material comprising the joint, and of the wall thickness of the connecting region.

BRIEF DESCRIPTION OF THE DRAWING

A preferred exemplary embodiment of the invention will now be described in further detail with reference to the drawings, in which.

DETAILED DESCRIPTION OF THE INVENTION

Figure 1:
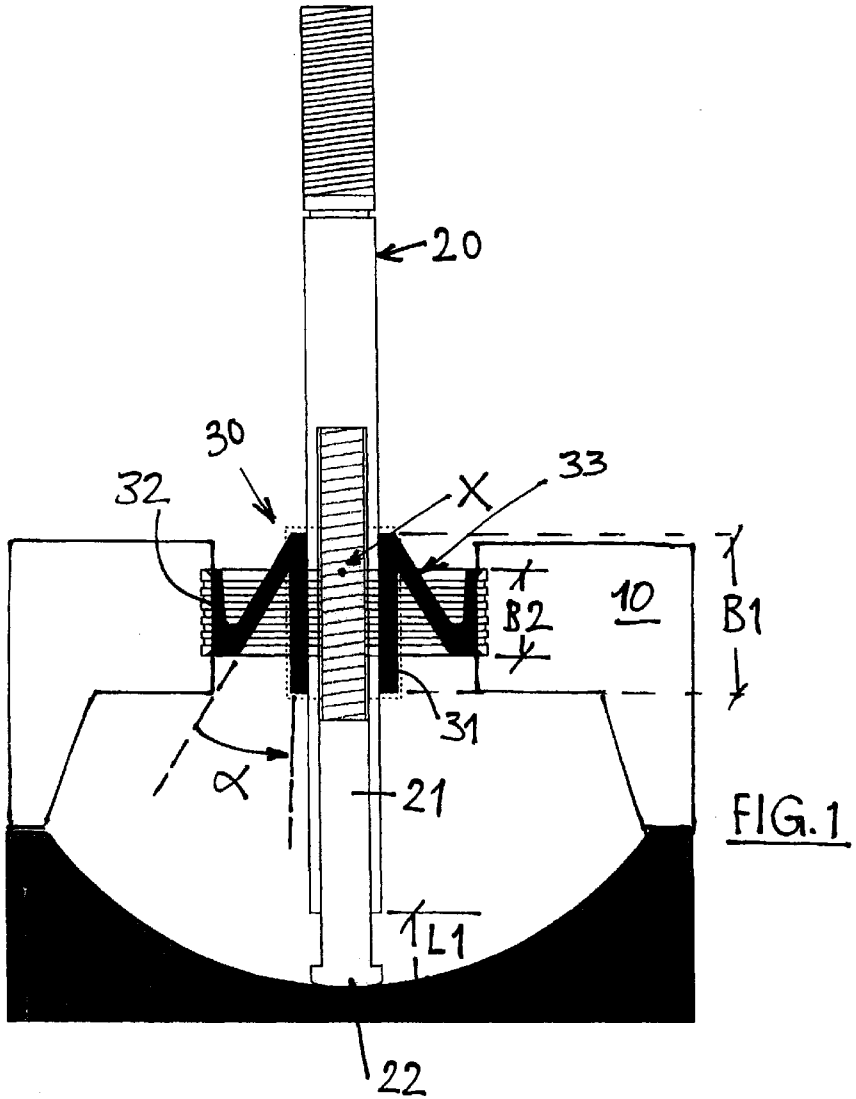
FIG. 1 is a schematic cross-sectional view of a joystick and joint according to the invention in the normal position, that is, the position of repose.
Figure 2:
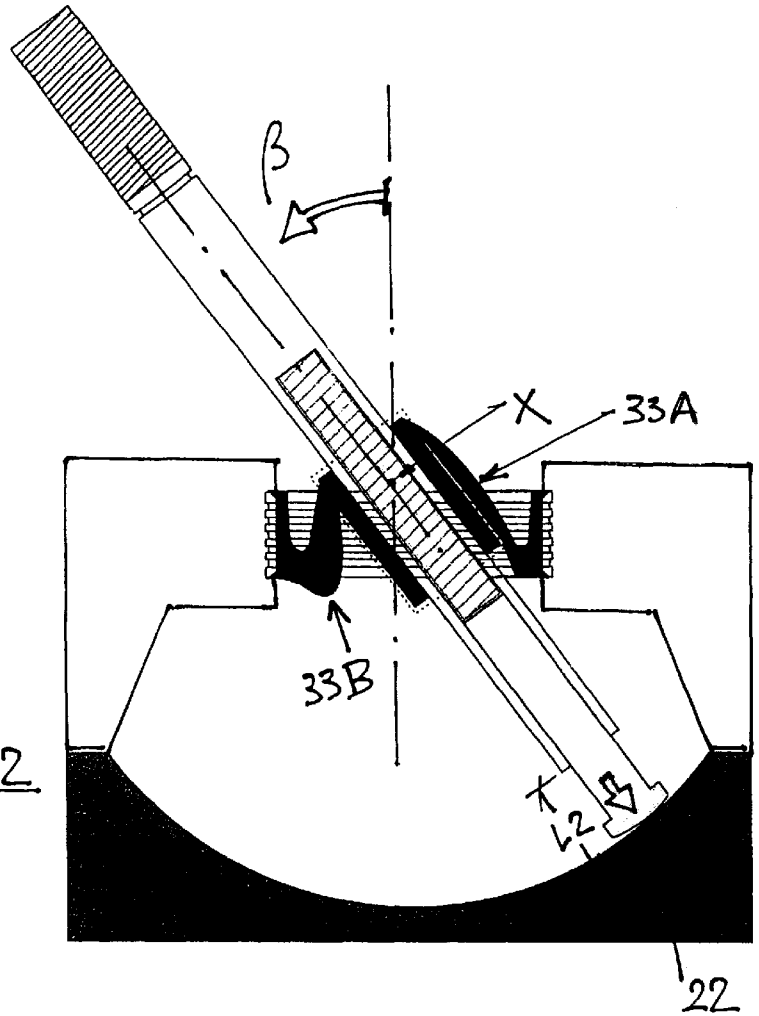
FIG. 2 is a cross-sectional view of the joystick of FIG. 1 in the deflected position.

The manual control device shown in FIGS. 1 and 2 comprises a housing 10, shown only schematically, in which a joystick 20 is retained pivotably via a joint 30. A spring-loaded tappet, or rod, 21 is coupled to the joystick 20, and its lower tip 22 is seated on a shell-like counterpart face having a part spherical form and provided in a conventional manner with switching or detecting elements that provide an indication of the position of lower tip 22 and thus of the angular position of joystick 20. This indication is provided in the form of a corresponding electrical signal that can be generated, for example, as described in EP 0 683 906 B1, cited above.

Joint 30 has an interior portion in the form of a first cylinder 31 that surrounds and fixes joystick 20. Cylinder 31 contacts joystick 20 over a first region having a dimension B1 along the joystick longitudinal axis. Joint 30 is secured to housing 10, for instance by being vulcanized in place, by means of a peripheral portion in the form of a second cylinder 32. Cylinder 32 contacts housing 10 over a second region having a dimension B2 in a direction that is parallel to the joystick longitudinal axis when joystick 20 is in its neutral position, as shown in FIG. 1.

Joint 30 further has a connecting portion 33 between the two concentrically located cylinders 31 and 32. Connecting portion 33 has a small wall thickness. Joint 30 is fabricated such that when joystick 20 is in its neutral position, connecting portion 33 has the form of a truncated cone and an opening angle $\alpha$, preferably of the order of 40° to 60°. In the exemplary embodiment shown, connecting portion 33 connects the upper edge of first cylinder 31 to the lower edge of second cylinder 32. The joint is preferably a plastic injection-molded part of nitrile butadiene rubber (NBR). Connecting region 33 preferably has a wall thickness of about 2 mm, and the wall thickness of the two cylinders 31 and 32 is of approximately the same order of magnitude, resulting in a relatively lightweight joint, which reacts readily and sensitively to pivoting motions imposed on joystick 20.

Joint 30 forms a floating support for the joystick because the articulation point X, as defined in FIG. 1, upon pivoting about the angle $\beta$ of FIG. 2, need not necessarily remain stationary but instead can migrated slightly upward as in the exemplary embodiment shown. The reason for this is, for the most part, the relatively sensitive thin-walled form of connecting region 33. Such longitudinal or transverse displacements are compensated for, however, by the fact that the spring-loaded tappet 21 is pressed against the shell-like inner surface of the lower housing part and thus forms a counterpart bearing, projecting from the lower end of the joystick 20 by a variable distance, as represented by the somewhat different distances L1 and L2 in FIGS. 1 and 2.

The sectional view of FIG. 2 shows that one part 33A of connecting region 33 is stressed virtually exclusively by expansion, that is, in the plane of its wall length, while, conversely, the opposed region 33B forms a kind of joint crease, in which a certain accumulation of material occurs. This type of stress has proved to be relatively gentle in the sense that it leads to long-lasting stability under load of the joint with simultaneously easy, sensitive manipulation.

The illustrated embodiment of frustoconical jacket 33 with its upper end pointing toward the upper end of joystick 20 brings about a high resistance of the joystick to axial tensile stress, i.e., to being pulled out of the housing. To counter axial pressure stress, i.e., pressing of joystick 20 into the housing, which is not hindered as much by this shaping of jacket 33, the invention provides that the displacement length L of tappet 21 relative to the body of joystick 20 is limited, as by suitable dimensioning of the spring that acts on tappet 21.

This application relates to subject matter disclosed in German Application Number 101 28 436.5, filed on Jun. 12, 2001, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A manual control device comprising:

a housing;

a joystick; and a joint supporting said joystick in said housing to enable said joystick to pivot about two mutually orthogonal axes relative to said housing, wherein said joint is an elastic molded plastic part composed of an interior portion secured to said joystick, a peripheral portion secured to said housing and a connecting portion extending between, and connecting, said interior portion and said peripheral portion, said interior portion has the form of a first cylinder and said peripheral portion has the form of a second cylinder, said first and second cylinders being concentric with one another when said joystick is in a neutral position, and said connecting portion is composed of a thin wall having a frustoconical shape when said joystick is in the neutral position and is stressed, when said joystick is pivoted away from the neutral position, in a manner such that one region of said connecting portion is stressed by expansion and another region of said connecting portion is stressed by compression.

2. The manual control device of claim 1, wherein said first cylinder has a length that is greater than the length of said second cylinder.

3. The manual control device of claim 1, wherein said connecting portion has an opening angle of 40 to 60° when said joystick is in the neutral position.

4. The manual control device of claim 1, wherein said joystick has an upper end that protrudes out of said housing and said connecting portion tapers in the direction of said upper end of said joystick.

5. The manual control device of claim 1, wherein said molded plastic part is of nitrile butadiene rubber (NBR).

6. The manual control device of claim 1, wherein said connecting portion has a mean wall thickness of the order of 2 mm.

7. The manual control device of claim 1, wherein said joystick is pivotable relative to said housing about an articulation point and said joystick comprises a main body having a lower end that projects into said housing, and a spring-loaded tappet supported at said lower end of said main body, said tappet having a lower tip that forms a counterpart support for said joystick such that the support provided by said lower tip compensates for vertical and/or horizontal displacements of the articulation point upon pivoting of said joystick away from the neutral position.

8. The manual control device of claim 7, wherein said tappet protrudes from the lower end of said main body by a minimum length in order to limit movement of said joystick into said housing.

9. The manual control device of claim 1, wherein said connecting portion has a frustoconical inner surface that faces said interior portion of said joint and a frustoconical outer surface that faces said peripheral portion of said joint.

* * * * *